US005983884A

United States Patent [19]

Lee

[11] Patent Number: 5,983,884

[45] Date of Patent: Nov. 16, 1999

[54] MODULAR GAS APPLIANCE SYSTEM

[75] Inventor: Duane A. Lee, Ringgold, Ga.

[73] Assignee: Maytag Corporation, Newton, Iowa

[21] Appl. No.: 08/862,667

[22] Filed: May 23, 1997

[51] Int. Cl.[6] ..... F24C 3/00

[52] U.S. Cl. ..... 126/39 R; 126/39 N; 138/44; 138/46

[58] Field of Search ..... 126/39 R, 39 K, 126/39 J, 41 R, 38, 39 N; 138/40, 44, 46

[56] References Cited

U.S. PATENT DOCUMENTS

| | | | |
|---|---|---|---|
| 1,078,584 | 11/1913 | Jones | 138/46 |
| 1,930,614 | 10/1933 | Hall | 138/44 |
| 2,187,010 | 1/1940 | Beckman et al. | 138/44 |
| 2,249,469 | 7/1941 | Gray et al. | 138/40 |
| 4,390,037 | 6/1983 | Perkins | 138/44 |
| 4,526,593 | 7/1985 | Meyerson | 138/44 |
| 4,889,103 | 12/1989 | Fraioli | 126/39 R |

*Primary Examiner*—James C. Yeung
*Attorney, Agent, or Firm*—Brinks Hofer Gilson & Lione

[57] ABSTRACT

The invention provides a modular gas cooktop system comprising a gas cooktop including compartments and standardized connections for a plurality of modular gas cooking units and an adapter. The standardized connections provide the maximum gas flow rates expected for use with the modular gas cooking units and the adapter provides gas flow rates compatible with the individual gas cooking units. The adaptor automatically reduces the gas flow rate provided to a modular cooking cartridge to match the gas flow requirement of the particular cartridge. The adapter can be added to the cartridge during the manufacturing process, thereby eliminating the requirement of removing an existing orifice from the gas appliance and replacing it with a second orifice when installing the cartridge in the gas appliance. The invention further includes a method for adapting the gas flow rate available to a modular cooking cartridge in a gas appliance.

9 Claims, 2 Drawing Sheets

MODULAR GAS APPLIANCE SYSTEM

The present invention relates to gas appliances, and particularly to modular gas appliances adapted to permit different gas cooking units to be connected to the same gas outlet. More particularly, the invention relates to a system including an adapter, coupled to a particular gas cooling unit, that changes the gas flow rate provided by the gas outlet (orifice) to a gas flow rate that matches gas input requirements of a particular cooking unit.

BACKGROUND OF THE INVENTION

Gas appliances, and in particular cooktops having modular, plug-in cooking units are known and commercially available. Typically, these cooktops have two or more compartments into which modular cooking cartridges are inserted. For example, one cooktop may include a surface burner cartridge disposed in one compartment and a grilling cartridge disposed in another compartment.

For ease of manufacturing, connections for the operation of the modular cooking cartridges are permanently installed in the gas appliance. The connections are disposed in the gas appliances so as to facilitate easy connection to a modular cooking unit and typically include identical gas outlets for each compartment for providing gas to the modular cooking cartridges. Thus, the manufacturer can manufacture standardized modular cooking cartridges and can more economically provide a wider variety of gas appliances as demanded by consumers.

Typically, the connections in the gas appliance include a gas orifice that is standardized to provide a gas flow rate suitable for surface burner units. Some modular cooking cartridges, such as grilling cartridges, however, require a lower gas flow rate than surface burner cartridges, and will not function properly at the higher gas flow rates. Thus, gas flow rate incompatibility presents a problem when installing, for example, a grilling cartridge into a standardized modular cooktop.

In conventional modular cooktops, this incompatibility problem is solved by removing the standard orifice and changing it to an orifice that matches the gas flow rate requirement of the cooking cartridge to be installed. This is inconvenient and undesirably wasteful in terms of labor and material.

SUMMARY OF THE INVENTION

The invention relates to a modular gas cooktop system comprising a gas cooktop including compartments and standardized connections for a plurality of modular gas cooking units providing the maximum gas flow rates expected for use with the modular gas cooking units and an adapter for attachment to individual modular gas cooking units to provide gas flow rates compatible with the individual gas cooking units.

The adaptor of the invention will automatically reduce the gas flow rate provided to a modular cooking cartridge to match the gas flow requirement of the particular cartridge. The adapter can be added to the cartridge during the manufacturing process and thereby eliminate the requirement of removing an existing orifice from the gas appliance and replacing it with a second orifice when installing the cartridge in the gas appliance.

In particular, the present invention provides a modular cooking cartridge for use in a gas appliance that includes a plurality of compartments for receiving modular cooking cartridges. The modular cooking cartridge comprises a standardized connection for receiving a gas orifice that delivers gas to a compartment at a first gas flow rate and an adapter for reducing the gas flow rate delivered to the modular cooking cartridge to a second gas flow rate required by the modular cooking cartridge. The adapter is adapted for coupling to modular cooking cartridges and to the gas orifice.

The invention further includes sealing means for providing a gas-tight connection between the adapter and the gas orifice. The adapter includes a sleeve for receiving the gas connection. The sleeve includes an end wall and a cylindrical side wall extending orthogonally from the periphery of the end wall, and the end wall includes an aperture.

The invention further includes a method for adapting the gas flow rate available to a modular cooking cartridge in a gas appliance. The method comprises the steps of providing a first gas orifice for delivering gas to the modular cooking cartridge at a first gas flow rate and providing an adapter for attachment to the modular cooking cartridge and to the gas orifice.

The adapter includes a second gas orifice that is smaller than the first gas orifice. The adapter further includes an end wall disposed downsteam of the first gas orifice and a cylindrical side wall extending orthogonally from the end wall. The second gas orifice is formed in the end wall. According to one aspect of the invention, the providing step includes the step of positioning sealing means between the cylindrical side wall and the gas outlet.

Additional objects, features and advantages will become apparent to those skilled in the art upon consideration of the following detailed description of a preferred embodiment exemplifying the best mode of carrying out the invention.

BRIEF DESCRIPTION OF THE DRAWINGS

The detailed description particularly refers to the accompanying figures in which.

DETAILED DESCRIPTION OF THE DRAWINGS

Figure 1:
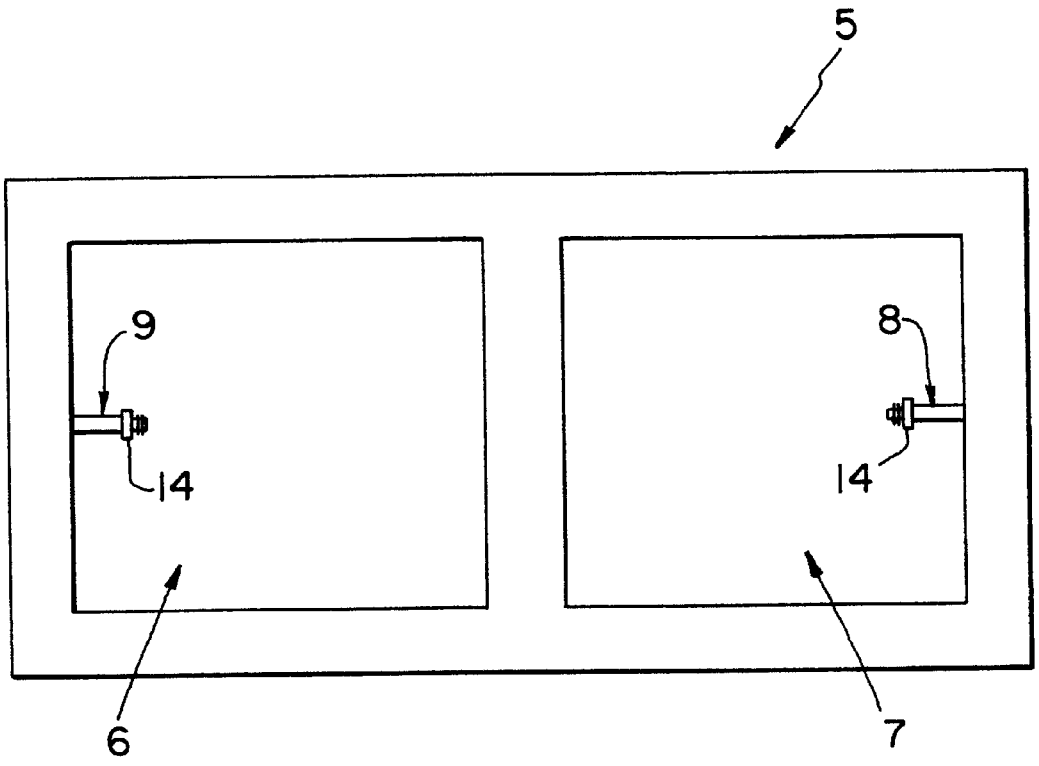
FIG. 1 is a diagrammatic drawing of a standardized cooktop with which the invention may be used.

The present invention provides a modular cooktop system as illustrated in FIGS. 1–4. As shown in FIG. 1, a gas cooktop provides a plurality of compartments 6 and 7 and gas connections 8 and 9 for a plurality of modular gas cooking units, including surface burner units (not shown) and grilling units 12, shown for example, in FIGS. 2–4.

The gas connections 8, 9 include gas orifices 18 that each provide a first gas flow rate providing the maximum gas flow rate required by modular gas cooking units compatible with the cooktop 5. As set forth below, the invention permits adaption of individual gas cooking units (e.g., grilling unit 12) that may not be for use of the first flow rate but for a lesser flow rate so they may be connected and used with the cooktop 5.

Figure 3:
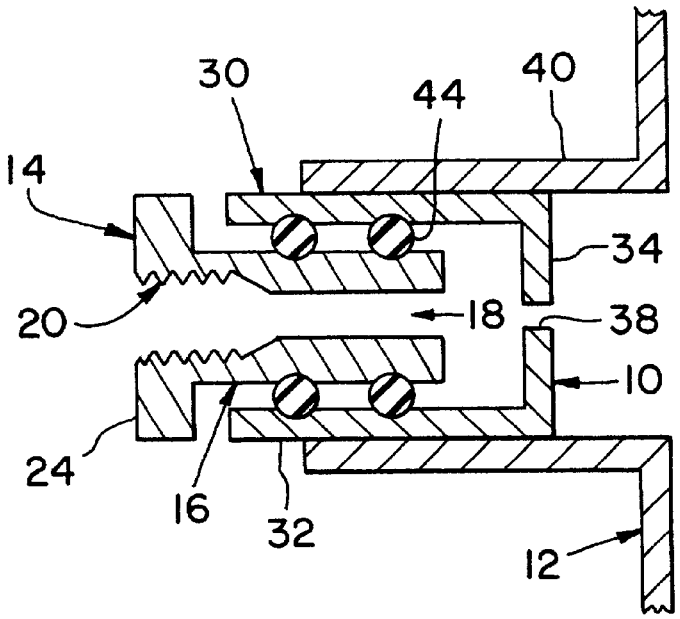
FIG. 3 is an illustration of an adapter disposed between a cartridge and a gas outlet.

The present invention provides an adapter 10 for reducing the gas flow rate to accommodate the gas flow requirements of a modular cooking cartridge 12. FIG. 3 illustration of an adapter 10 disposed between a standard or conventional gas orifice 14 and the modular cooking cartridge 12.

The conventional gas orifice 14 includes a cylindrical portion 16 having an internal bore 18 for delivering gas to a cooking cartridge 12 connected thereto. The internal bore 18 can include an internally threaded portion 20 for engaging a threaded gas line 8, 9 or a gas valve (not shown). The gas orifice 14 can also include a flange 24 extending radially outwardly from the cylindrical portion 16. Preferably, the flange 24 forms a hex nut for facilitating installation and removal of the gas orifice 14.

The diameter of the internal bore 18 depends upon the particular application involved. For example, a natural gas supply having on average heating value of about 1025 BTU/cubic foot at about 5 inches water column pressure supplied to a gas orifice 14 with a bore corresponding to a drill size No. 52 orifice would deliver gas to achieve a heating output rate of about 12,800 BTU/Hr, which is desirable for a conventional surface burner. However, a grilling unit conventionally operates with a gas flow to achieve a heating output rate of about 8,000 BTU/Hr, which correlates to a drill size No. 55 orifice. Thus, in conventional gas cooktops, a gas orifice 14 with a No. 52 orifice would have to be removed and replaced with a gas orifice with a No. 55 orifice in order to deliver gas to a grilling unit at an appropriate gas flow rate.

The adapter 10 includes a sleeve 30 having a cylindrical side wall 32 having an inner diameter slightly larger than the outer diameter of the cylindrical portion 16 of the gas orifice 14. In one embodiment of the invention, the adapter 10 includes an end wall 34 extending orthogonally from the cylindrical side wall 34 and formed to include a second gas orifice 38. The second gas orifice 38 is sized to deliver gas at a second gas flow rate that is different from the gas flow rate of the first gas orifice 14.

Figure 2:
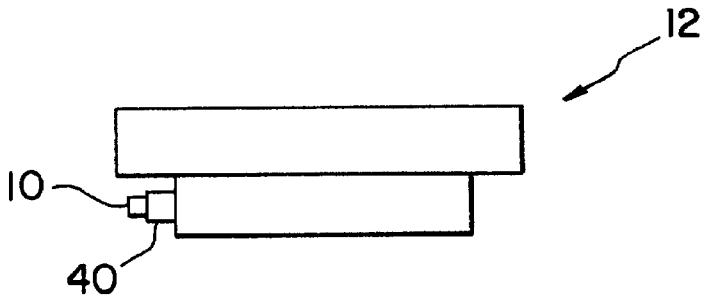
FIG. 2 is a side view of a grilling unit for use with the cooktop of FIG. 1.

As illustrated in FIGS. 2 and 3, the adapter 10 is disposed in a hose or coupling 40 attached to the cooking cartridge 12. The outer diameter of the adapter 10 is substantially equal to the inner diameter of the hose or coupling 40 so as to provide a gas-tight fit between the adapter 10 and the coupling 40. The cylindrical portion 16 of the gas orifice 14 fits inside the cylindrical side wall 32, with o-rings 44 or other sealing means providing a gas-tight seal between the first gas orifice 14 and the adapter 10.

Figure 4:
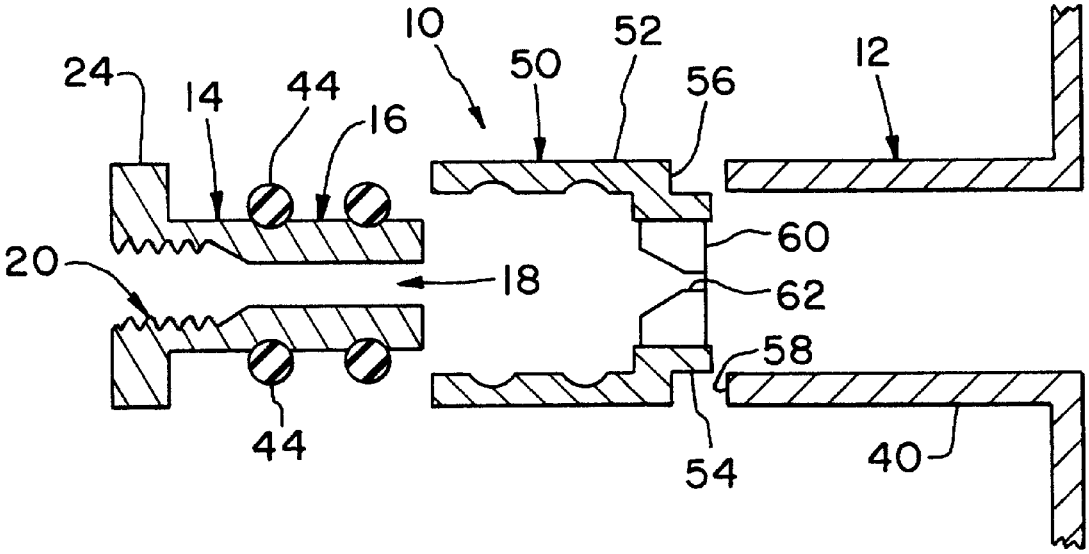
FIG. 4 is an illustration of an alternative embodiment of the adapter aligned to couple a cartridge to a gas outlet.

An alternative embodiment of the adapter 50 is shown in FIG. 4. As illustrated, the adapter 50 includes first and second cylindrical side walls 52, 54 with a shoulder 56 therebetween. The cylindrical side walls 52, 54 are sized to allow the second cylindrical side wall 54 to extend inside the coupler 40 attached to the modular cooking cartridge 12 while allowing an end 58 of the coupler 40 to butt against the shoulder 56. Preferably, the second cylindrical side wall 54 is joined with the coupler 40 with a press fit to provide a gas-tight connection. Thus, the first cylindrical side wall 52 essentially forms an extension of the coupler 40. It will be appreciated that adapter 50 can be provided with an inner cylindrical side wall that can be sized to provide a press fit over the outside of the coupler 40.

The adapter 50 further includes an end wall 60 having a second gas orifice 62 formed therein. It will be appreciated that the adapter 50 can be formed from a single piece of material so as to include the shoulder 56 and an integral end wall 60. Alternatively, the end wall 60 can be preformed to include a second gas orifice 62 and press fit within the second cylindrical side wall 54, as illustrated in FIG. 4. In any event, when the adapter 50 is press fit or otherwise attached to the coupler 40, the second gas orifice 62 will be disposed between the first gas orifice 14 and the modular cooking cartridge.

The present invention provides means for automatically accommodating the gas flow requirements of a modular cooking cartridge without removing and replacing an existing orifice having a higher gas flow rate. Thus, a basic modular gas appliance can be manufactured using a first gas orifice 14 that provides the maximum gas flow rate required by the possible selections of modular cooking cartridges to be used. The particular gas flow rate required by any particular modular cooking cartridge can be accommodated by including an adapter 10 having an appropriate second gas orifice 62 added to the modular cooking cartridge during the manufacturing process.

Although the invention has been described in detail with reference to certain preferred embodiments, variations and modifications exist within the scope and spirit of the invention as described and defined in the following claims.

I claim:

1. A modular cooktop system for use in a gas appliance, comprising:

at least one compartment disposed in said gas appliance;

a modular cooking cartridge received in said compartment, wherein said modular cooking cartridge includes a connection for receiving a gas orifice that delivers gas to said at least one compartment at a first gas flow rate; and an adapter, coupled to the modular cooking cartridge and the gas orifice, for reducing the gas flow rate delivered to the modular cooking cartridge to a second gas flow rate required by the modular cooking cartridge.

2. The modular cooking cartridge of claim 1 further including a seal for providing a gas-tight connection between the adapter and the gas orifice wherein the adapter includes a sleeve for receiving the gas orifice.

3. The modular cooking cartridge of claim 2 wherein the sleeve includes an end wall and a cylindrical side wall extending orthogonally from the periphery of the end wall, the end wall including an aperture.

4. A method for reducing a gas flow rate to a modular cooking cartridge in a gas appliance, the method comprising the steps of:

directing a flow of gas at a first gas flow rate through a first gas orifice; and coupling an adapter with the modular cooking cartridge and the first gas orifice, the adapter further including a second gas orifice downstream of said first gas orifice capable of directing said flow of gas to said modular cooking cartridge at a second gas flow rate, said second gas flow rate being less than said first gas flow rate.

5. The method of claim 4 further comprising the step of providing said adapter with an end wall disposed downstream of the first gas orifice and a cylindrical side wall extending orthogonally from the end wall, the second gas orifice being formed in the end wall.

6. The method of claim 5 further comprising the step of positioning a gas-tight seal between the cylindrical side wall and the gas outlet.

7. A method of adapting a gas appliance with a plurality of locations for receipt of modular cooking units, including modular burner units and modular grilling units requiring different maximum flow rates, to interchangeably receive modular burner units and modular grilling units at each of the plurality of locations, comprising the steps of:

providing a gas supply line at each of the plurality of locations with a flow controlling gas orifice providing the maximum gas flow rate for the modular cooking units; and providing each modular grilling unit to be used with the cooktop with an adapter including a flow controlling gas orifice providing the lower maximum gas rate for the modular grilling unit.

8. A modular gas cooktop system for use with a plurality of plug-in modular cooking units, comprising:

a gas cooktop including a plurality of compartments for receiving one of the plurality of plug-in modular cooking units, each compartment including a gas supply connector having a first flow controlling gas orifice providing the maximum gas flow rate required by the plurality of plug-in modular cooking units;

at least one plug-in modular cooking unit requiring less than the maximum gas flow rate and carrying an adapter at its gas inlet with a second flow controlling gas orifice providing a reduced gas flow rate, said adapter being engageable with said gas supply connections of each of said compartments of the cooktop; and at least one plug-in modular cooktop unit requiring the maximum gas flow rate.

9. The modular gas cooktop system of claim 8 wherein the connections of each compartment include a plug-like cylindrical portion carrying a gas seal, and the adapter includes a sleeve portion having an inner cylindrical surface accepting the plug-like cylindrical portions of said connections and providing a sealing surface for said gas seal.

* * * * *